United States Patent [19]

Dobbs

[11] Patent Number: 4,706,888

[45] Date of Patent: Nov. 17, 1987

[54] MULTI-PURPOSE NOZZLE ASSEMBLY

[75] Inventor: Douglas B. Dobbs, Yorba Linda, Calif.

[73] Assignee: Calmar, Inc., Watchung, N.J.

[21] Appl. No.: 884,437

[22] Filed: Jul. 11, 1986

[51] Int. Cl.[4] ..... B05B 1/34

[52] U.S. Cl. ..... 239/478; 239/483; 239/493

[58] Field of Search ..... 239/476–479, 239/482–484, 492, 493, 538, 461

[56] References Cited

U.S. PATENT DOCUMENTS

| | | | |
|---|---|---|---|
| 3,843,030 | 10/1974 | Micallef | 239/478 X |
| 3,967,765 | 7/1976 | Micallef | 239/478 X |
| 4,234,128 | 11/1980 | Quinn et al. | 239/478 |
| 4,365,751 | 12/1982 | Saito et al. . | |
| 4,516,695 | 5/1985 | Garneau | 239/478 X |

*Primary Examiner*—Andres Kashnikow
*Assistant Examiner*—Mary Beth O. Jones
*Attorney, Agent, or Firm*—Watson, Cole, Grindle & Watson

[57] ABSTRACT

A multi-purpose nozzle assembly for a liquid dispenser includes a rotatable nozzle cap having an internal sleeve in engagement with the end of a fixed plug located within an outlet member of the dispenser containing a discharge conduit. An end wall of the cap has a smooth inner surface confronting the end wall of the plug, and the plug and sleeve have two discrete passageways formed between the discharge conduit and the discharge orifice located in the cap end wall. The passageways are capable of being opened and closed in selected rotative positions of the cap in alternating off, stream and spray positions.

3 Claims, 7 Drawing Figures

MULTI-PURPOSE NOZZLE ASSEMBLY

BACKGROUND OF THE INVENTION

This invention relates generally to a multi-purpose nozzle assembly for a liquid dispenser, and more particularly to such a nozzle assembly having improved control between off and selected discharge positions.

Various types of multi-purpose nozzle assemblies have been developed for liquid dispensers, but are not without their drawbacks. For example, U.S. Pat. No. 3,843,030 has its nozzle cap containing an off-centered discharge orifice which must be shifted upon cap rotation between alignment with the spin chamber at the end of an internal probe for producing a spray, and a channel on the probe for producing a stream. The off-center location of the discharge orifice not only presents problems for the consumer in properly targeting the discharge, but gives rise to a shearing action during cap rotation in that the inner edge of the discharge orifice must traverse the plug surface containing the spin chamber and associated tangentials which could cause abrasions or snags between the rotating parts resulting in undue wear and leakage.

The nozzle assembly of U.S. Pat. No. 3,967,765 has a spin chamber with associated tangential and radial grooves formed on the inner surface of the cap end wall, and transverse feed grooves at the end of an internal plug bearing against such wall. Thus, the details provided for adjustment between spray and stream positions are located on each of two rotatable parts which not only creates tooling difficulties but presents ridges or corners which must pass one another during cap rotation resulting in a shearing action which could score or abrade one or both confronting parts and cause leakage. Besides, an extra slotted, internal sleeve is required in telescoping relation to a slotted cap sleeve to effect a spigot-type shut off which, however, because of the thin-walled sleeves, can create leakage.

The nozzle assembly of U.S. Pat. No. 4,234,128 likewise requires the spin chamber and associated tangential grooves to be formed on the underside of the cap end wall, and passages and slots on an internal plug arranged to produce a stream or spray discharge or shut-off. Thus, some of the details for the dispense function are on the cap end wall and some others are on the plug confronting this end wall, such that a shearing action results between these details as they pass one another upon cap rotation. Due to such abrasive and interrupted engagement between rotating parts, scoring, snags and/or undue wear occurs with consequent leakage.

The nozzle assembly of U.S. Pat. Nos. 4,365,751 and 4,516,695 likewise requires cooperating dispense function details to be located on the underside of the cap end wall and the confronting end of an internal plug which thereby presents ridges or corners producing a shearing action during cap rotation and undue wear with possible leakage.

SUMMARY OF THE INVENTION

It is therefore object of the present invention to provide a multi-purpose nozzle assembly for a liquid dispenser of bottles or containers which may be sealed closed or selectively adjusted into spray or stream discharge open positions in a highly reliable, more economically produced, less difficult and leakproof manner.

Another object of this invention is to provide such an assembly wherein a rotatable nozzle cap has an end wall containing a central discharge orifice, the end wall having a smooth inner surface and a surrounding sleeve engaging an internal plug at the discharge conduit, the plug and the sleeve having means defining two discrete passageways between the discharge passage and the discharge orifice respectively in two rotative discharge open positions of the cap for respectively producing a spray and a stream discharge.

In carrying out these general objectives, the internal plug has at least two longitudinal grooves, and the end of the plug has a central depression which defines a chamber with the smooth inner surface of the cap, and the plug end wall also has at least one tangential channel and at least one radial channel respectively interconnecting the depression with the side grooves on the plug. And, at least one longitudinal passage is located in the inner peripheral wall of the sleeve, such passage communicating with one of the grooves leading to the radial channel for producing a stream discharge in one rotative position of the cap, and the passage communicating with the other groove leading to the tangential channel for producing a spray discharge in another rotative position of the cap.

Other objects, advantages and other features of the invention will become more apparent from the following detailed description of the invention when taken in conjunction with the accompanying drawings.

BRIEF DESCRIPTIONS OF THE DRAWINGS

Figure 2:
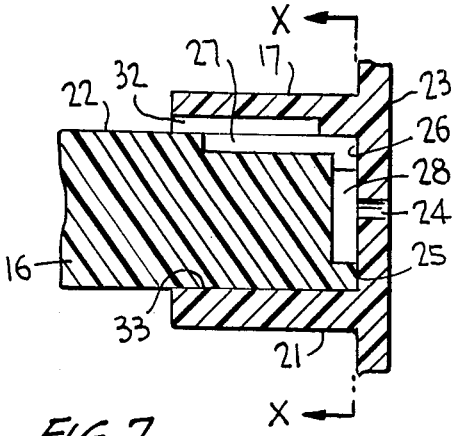
FIG. 2 is a view similar to FIG. 1 of an enlarged cross section of the present nozzle assembly.
Figure 3:
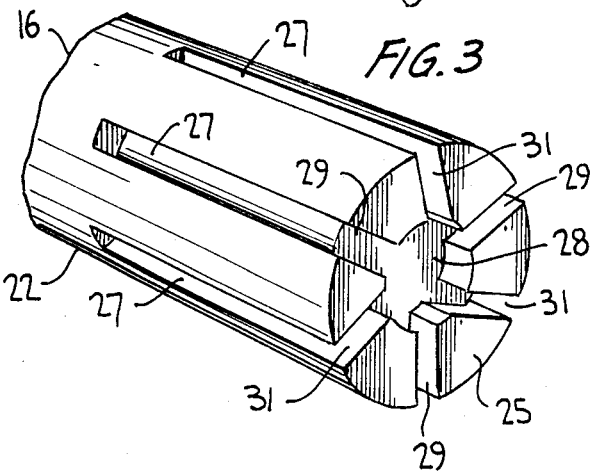
FIG. 3 is a perspective view of the internal plug element which is engaged by the nozzle cap.
Figure 7:
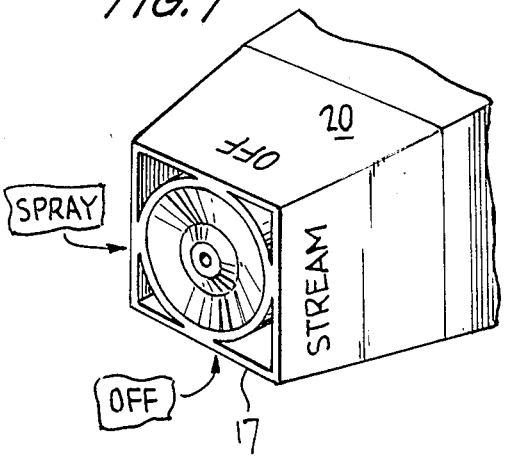
Figure 4:
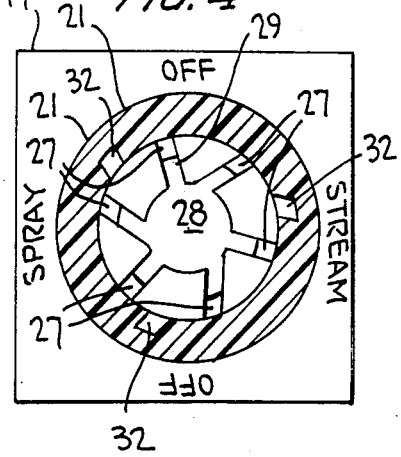
Figure 5:
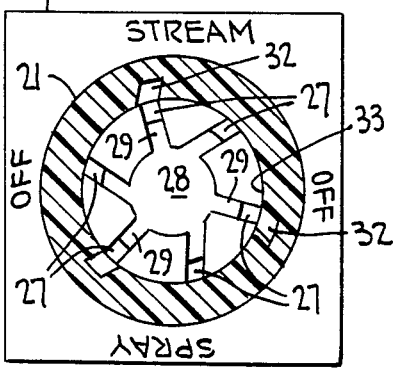
Figure 6:
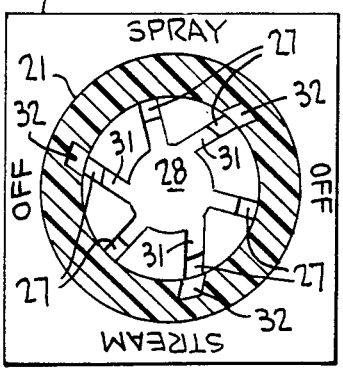

FIGS. 4, 5, and 6 are views taken substantially along the line X—X of FIG. 2 showing relative rotated positions of the cap in off, stream and spray positions; and FIG. 7 is a perspective end view of the nozzle cap.

DETAILED DESCRIPTION OF THE INVENTION

Figure 1:
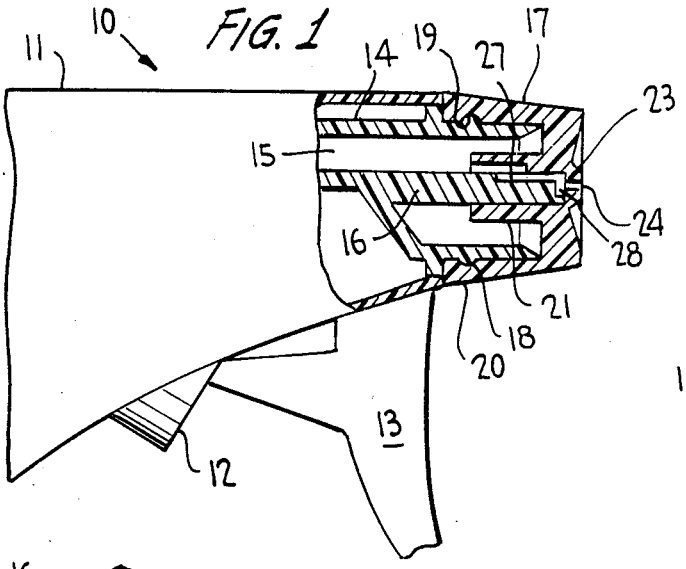
FIG. 1 is a side view of a part of a liquid dispenser incorporating the multi-purpose assembly of the invention shown in section.

Turning now to the drawings wherein like reference characters refer to like and corresponding parts throughout of several views, part of a liquid dispenser 10 is shown in FIG. 1 in the form of a manually operated trigger dispenser which incorporation the multi-position nozzle assembly of the invention. However, the nozzle assembly is likewise adapted for a manually operated squeeze bottle dispenser or an aerosol pump dispenser.

The dispenser comprises a pump body 11 having a pump cylinder 12 containing a reciprocable pump piston (not shown) which is manually reciprocated by a trigger actuator 13 hingedly mounted on the pump body. A tubular outlet member 14 of the dispenser has a discharge conduit or passage 15 through which liquid product is adapted to pass during the pumping operation. A fixed, coaxial core or plug element 16 is formed in the outlet member, and a nozzle cap 17 is externally mounted on the end of the outlet member by a snap fit produced between an external rib 18 on member 14 and an internal groove 19 on internally cylindrical cap skirt 20. The nozzle cap may have a rectangular external configuration, as shown in FIG. 7, to facilitate manual rotation of the cap on the outlet member, and to conveniently receive markings on each four side walls, such as OFF on a pair of opposed walls, STREAM on one of the other walls and SPRAY on the remaining wall.

The nozzle cap has a coaxial, internal, cylindrical sleeve 21 which tightly engages peripheral wall 22 of plug 16 at its outer end. The nozzle cap has an end wall 23 containing a central discharge orifice 24 coaxial with member 14, the end wall having a smooth and uninterrupted inner surface 26 confronting an end wall 25 of the plug such that none of the details for affecting spray discharge are carried by wall 23, as will be further described hereinafter.

The plug has a plurality of equally spaced longitudinal grooves 27 formed in its outer periphery 22, at least two of such grooves being required, and six of such grooves being illustrated in the drawings, although even numbers of grooves 27, other than two or six may be provided without departing from the invention.

End wall 25 of the plug has a central depression 28 forming a chamber with confronting surface 26. A set of three equally spaced radial channels 29, and a set of three equally spaced tangential channels 31 are likewise formed in end wall 25, the radial and tangential channels being alternatively disposed, as shown in FIGS. 3 to 6. And, the channels respectively extend between and interconnect central depression 28 with grooves 27. It should be noted that those grooves 27 which interconnect with tangential channels 31 may have the sidewalls lying at the same angle as that of the tangential channels so as to assure a smooth and uninterrupted passage of liquid product therealong.

At least one, and in the example illustrated three equally spaced, passages 32 are formed in inner peripheral wall 33 of skirt 21, the grooves being open at their inner ends as shown in FIG. 2, and terminating a spaced distance from the outer ends of grooves 27.

Grooves 27, passages 32 and channels 29,31 are relatively arranged such that the nozzle cap may be rotated about its central axis between off—stream, stream—off, off —spray and spray—off positions upon respective quarter turns of the cap. Thus, in both off positions, shown in FIG. 4, discharge conduit 15 is sealed closed preventing any liquid product from being dispensed through the discharge orifice. In the off position, each passage 32 is out of alignment and communication with any of the grooves 27 such that the lands or uninterrupted portions of inner peripheral wall 33 of cylindrical sleeve 21 tightly seal against the lands between grooves 27. Upon a 90° rotation of the cap in a counterclockwise direction, for example, from the FIGS. 4, 7 position to that of the FIG. 5, passages 32 of sleeve 21 are at least partially aligned and in communication with three alternate grooves 27 which interconnect with radial channels 29 such that liquid product is adapted to pass from discharge conduit 15 through passages 32, open grooves 27 and radial channels 29 into chamber 27 and out through discharge orifice 24 in a stream pattern. In the stream position of the FIG. 5, chamber 28 does not function as a swirl chamber since the radial entry of liquid product proceeds through the chamber and out through the discharge orifice in a linear flow pattern so as to be ejected as a stream.

Upon rotation of the nozzle cap from the FIG. 5 stream position through 90° in a clockwise direction, for example, passages 32 will once again be misaligned and out of registry with any of grooves 27 to thereby seal off the discharge conduit as in the FIG. 4 position. Otherwise, if the nozzle cap is rotated counterclockwise through 90° from its FIG. 5 stream position, passages 32 will likewise be disposed out of communication with grooves 27 for shutting off the discharge, as viewed with FIG. 4 inverted.

From the off position of FIG. 4, the nozzle cap may be rotated clockwise through 90° into its FIG. 6 position in which passages 32 are now in at least partial alignment and communication with alternate grooves 27 which interconnect with tangential channels 31. In this position, the liquid product is adapted to pass from discharge conduit 15, through passages 32, open grooves 27 and tangential channels 31 into swirl chamber 28 and out through the discharge orifice in a spray pattern. Since those grooves 27 connecting with radial channels 29 are blocked in this FIG. 6 position, a vortex is created in the spin chamber as liquid product enters through the tangential channels, so as to be ejected as a spray as when issuing from a typical swirl chamber.

From the FIG. 6 position, the nozzle cap may be rotated through 90° either clockwise or counterclockwise into one of the two off positions of FIG. 4 (when viewed inverted or upright, respectively).

Since inner surface 26 of cap end wall 23 is smooth and uninterrupted with central discharge orifice 24 always coaxial with central depression 28 with surface 26 bearing against the surface segments of wall 25 defined by channels 29,31, rotation of the cap between its off, stream and spray positions avoids any shearing action or abrasion between surface 26 and the confronting surface of wall 25 at the end of the plug. All the details for the open discharge functions are formed on the plug itself, so that no corners or details acting between surface 26 and the surface of end wall 25 pass one another during cap rotation, and any shearing action causing abrasion of these surfaces or the details thereof is avoided. Leakages are consequently minimized and postively controlled.

Obviously, many other modifications and variations of the present invention are made possible in the light of the above teachings. It is therefore to be understood that within the scope of the appended claims the invention may be practiced otherwise than as specifically described.

What is claimed is:

1. A multi-purpose nozzle assembly for a liquid dispenser, comprising, a tubular outlet member having a discharge passage through which liquid product is adapted to pass, a fixed, coaxial plug element located in said tubular member, a nozzle cap having a central discharge orifice and being mounted for relative rotation between at least one discharge closed position and two selective discharge open positions without axial displacement at the end of said tubular outlet member, said cap having an inner cylindrical sleeve in rotative engagement with said plug element, the peripheral surface of said plug element having longitudinal grooves, said plug element having an end wall with a central depression coaxial with said discharge orifice, alternating tangential and radial channels in said end wall extending between said depression and said longitudinal grooves, said channels presenting spaced surface segments at said end wall, said cap having a wall containing said discharge orifice and having a completely smooth and uninterrupted inner surface which confronts said end wall and defines a chamber with said depression, said inner surface bearing against said surface segments and avoiding any shearing action therewith during said relative rotation, and longitudinal passages in an inner peripheral surface of said sleeve, said grooves and said passages being relatively arranged such that upon rotation of said cap into said discharge closed position said grooves and said passages are mismatched, upon rotation of said cap into a first of said discharge open positions said grooves and said passages are matched and register with said radial channels, and upon rotation of said cap into a second of said discharge open positions said grooves and said passages are matched and register with said tangential channels.

2. The nozzle assembly according to claim 1, wherein said cap is mounted for relative rotation between two selective discharge closed positions said grooves and said passages being relatively arranged such that upon rotation of said cap through 90° from either of said closed positions said grooves and said passages are matched at either of said discharge open positions.

3. The nozzle assembly according to claim 2, wherein there are provided three of said passages equally spaced, six of said grooves equally spaced, and three of each of said tangential and radial channels in alternating relationship.

* * * * *